United States Patent [19]

Pond

[11] 4,067,018

[45] Jan. 3, 1978

[54] EXCESSIVE MAGNETIC DEVELOPER DISPLACEMENT SYSTEM

[75] Inventor: Stephen F. Pond, Fairport, N.Y.

[73] Assignee: Xerox Corporation, Stamford, Conn.

[21] Appl. No.: 608,357

[22] Filed: Aug. 27, 1975

[51] Int. Cl.[2] ..... G03G 15/08

[52] U.S. Cl. ..... 346/74.1; 118/56; 118/652

[58] Field of Search ..... 118/637, 639, 52, 56, 118/63, 64, 652; 355/15; 346/74.1

[56] References Cited

U.S. PATENT DOCUMENTS

| | | | |
|---|---|---|---|
| 3,052,564 | 9/1962 | Kulesza | 235/61.12 M |
| 3,541,577 | 11/1970 | Lemke | 360/16 |
| 3,611,987 | 10/1971 | Kohler | 118/63 |
| 3,735,416 | 5/1973 | Ott | 346/74.1 |
| 3,852,525 | 12/1974 | Ichioka | 346/74.1 |
| 3,871,326 | 3/1975 | Kanda | 118/63 |

*Primary Examiner*—Jay P. Lucas

*Attorney, Agent, or Firm*—James J. Ralabate; James P. O'Sullivan; George J. Cannon

[57] ABSTRACT

Developed members having a magnetic latent image and comprising magnetic developer material in imagewise configuration corresponding to the latent image and additional magnetic developer material in background areas is rendered substantially free of excessive magnetic developing material by subjecting the member to an acceleration of magnitude sufficient to displace excessive developer material from said member in background and images areas but insufficient to adversely effect the optical density of the imagewise configured deposition of developer material. Preferably, the excessive developer material displaced from said member is removed from the vicinity of said member by application of air streams along the developed surface of said member.

18 Claims, 3 Drawing Figures

EXCESSIVE MAGNETIC DEVELOPER DISPLACEMENT SYSTEM

BACKGROUND OF THE INVENTION

This invention relates to removal of excess magnetic developing material from a developed, magnetially latently imaged member.

Latently imaged members such as, for example, electrostatically latently imaged xerographic photoconductive members and latently megnatically imaged magnetographic imaging members are typically developed by deposition of developer material on the imaging member. In magnetic imaging the developing material is magnetic and attracted by magnetic fields to the latent magnetic image created in a magnetizable imaging member such as, for example, ordinary magnetic recording tape. In electrostatographic imaging systems such as, for example, xerography, the developing material typically comprises the two components of carrier and toner. The toner material is typically capable of becoming triboelectrically charged and, owing to this charge, is attracted to the charge pattern residing on the photoconductive imaging member. In either case, as a practical matter, developer material is attracted to and deposited upon the imaging member not only in imagewise configuration in areas of the member corresponding to the latent image but also is deposited upon non-image areas of the imaging member. However, the magnitude of background attraction in magnetic imaging is typically much less than that in xerographic imaging. For example, typical xerographic background forces acting on xerographic toner are from about 1 to about 2 millidynes which are the magnetic forces exerted in magnetically latently imaged areas. The background forces exerted by magnetically latently imaged members are much less than that of the image areas of the magnetic latent image and the background forces exerted by electrostatically latently imaged members.

These non-image or background areas of the imaging member which bear developing material will transfer these developer materials to the copy medium employed during transfer of the imagewise configured deposition of developing material to the copy medium. Such transfer results in reduced contrast between the transferred image and copy medium and is, therefore, generally undesirable.

Further, in developing latent magnetic images on a magnetizable member it is necessary due to the short range nature of magnetic forces (rapid decrease with distance) to introduce the developing material within a very short distance from the latent magnetic image, typically within about 10 microns of the image, to ensure development of the latent image. This extremely close proximity generally means that developing material will deposit on background areas and, in addition, the latent magnetic image is susceptible to over-development. Over-development, as used herein, means a plurality of layers of magnetic developing material. Over-development of the latent magnetic image is undesirable because, upon transfer to the copy medium, the imagewise configured developing material is susceptible to smearing and smudging, the transferred plurality of layers of developing material is difficult to affix to the copy medium and therefore permanency of the image on the final copy is impaired, and undesired powder clouds of developing material are more likely to be generated within the system when the latent image is over-developed. These powder clouds, in turn, contribute to background and to malfunctioning of imaging apparatus.

The desirability of removing excessive xerographic developing material is well known and recognized in the xerographic art; and is indicated in the magnetic imaging art such as, for example, in U.S. Pat. No. 3,120,806 wherein direct flood developing of the copy medium under the influence of, but out of contact with the latent magnetic image, is followed with air-knife removal of excessive developing material.

SUMMARY OF THE INVENTION

It is an object of the invention to provide a novel system and process for the removal of magnetic developing material from background areas of an imaging member.

It is a further object of this invention to provide a novel system and process for cleaning up over-developed magnetic latent images residing on an imaging member.

It is still a further object of this invention to provide a novel system and process for removing excessive magnetic developing material from magnetically latently imaged members.

It is yet still a further object of this invention to provide for the high speed removal of excessive magnetic developing material from a magnetically latently imaged member.

Another object of this invention is to remove excessive magnetic developing material from a magnetically latently imaged member moving at high speeds.

The foregoing objects and others are accomplished in accordance with this invention by deliberately subjecting the developed latently imaged member to an acceleration of predetermined magnitude, said predetermined magnitude being effective to overcome forces retaining the excessive developing material thereby displacing the excessive developing material from the imaging member but insufficient to adversely affect the desired optical density of the developed latent image. That is, while some developing material in imagewise configuration is removed and desirably so when the latent image is over-developed, the predetermined magnitude of the acceleration is insufficient to detach all of the developing material (preferably leaving at least one monolayer and optically one and one-half monolayers) in the plurality of layers of developing material in an overdeveloped image. Air streams are preferably directed along portions of the imaging member subjected to the acceleration to remove displaced developing material from the vicinity of said imaging member and thereby prevent the random redeposition of the developing material thereon.

BRIEF DESCRIPTION OF THE DRAWINGS

For a better understanding of the invention as well as other objects and further features thereof, reference is made to the following detailed disclosure of the preferred embodiments of the invention taken in conjunction with the accompanying drawings thereof, wherein.

DESCRIPTION OF THE PREFERRED EMBODIMENTS

While the following detailed description of the preferred embodiment of centrifugal acceleration is utilized throughout, it will be understood that any acceleration direction except toward the tape can be utilized herein.

Figure 1:
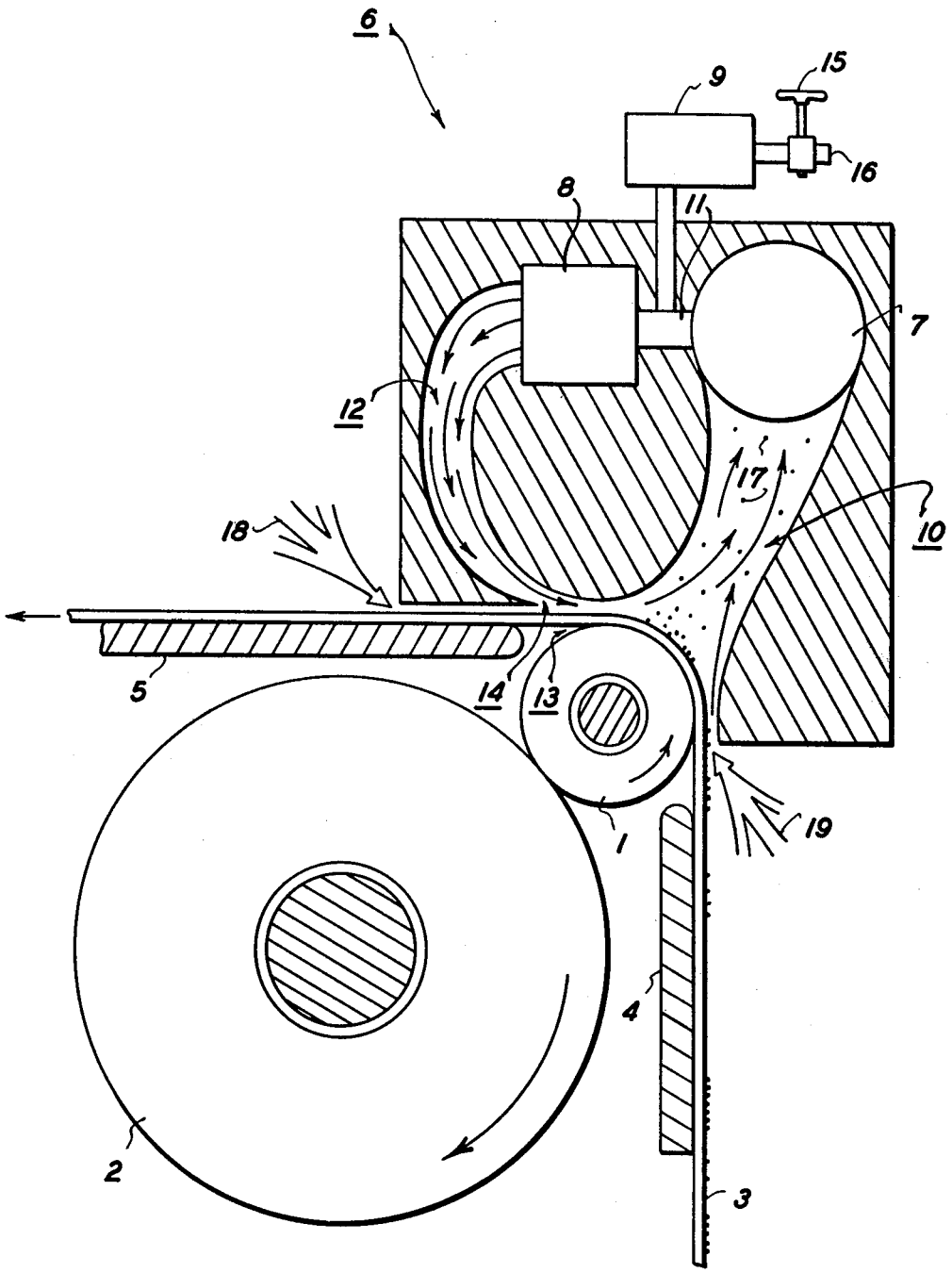
FIG. 1 is a schematic illustration of a typical device which provides both the acceleration and the optional air-streams in accordance with the practice of the present invention.

Referring now to FIG. 1, there is seen a magnetic tape imaging member 3, deiven by rollers not shown, passing over small radius roller 1. Roller 1 is supported by large roller 2. The rotation of roller 2 in one direction results in the rotation of roller 1 in the other direction (for example, clockwise to counterclockwise) and therefore synchronous roller surface and tape 3 movement in that direction. Vacuum assembly 6 comprises fan 7, filter 8, filter 9, a preferably venturi-shaped chamber 10 providing communication between the negative pressure side of fan 7 and the atmosphere surrounding tape 3 along the portions of tape 3 in contact with roller 1, chamber 11 providing communication between the positive pressure side of fan 7 and filters 9 and 8, chamber 12 providing communication between filter 9 and the atmosphere surrounding tape 3 at a location just forward of the disengage point 13 where tape 3 moves out of contact with roller 1, opening 14 of chamber 12 being aligned to allow positive pressure flow from chamber 12 to venturi-shaped chamber 10. Positive pressure air flow is selectively bled off into the atmosphere into filter 8 and bled off line 16 by valve 15.

Tape 3 is moved at a constant velocity magnitude V and the individual particles 17 of developing material are subjected to a centrifugal force F equal to $m(V^2/R)$ wherein R is the radius of roller 1, $m$ is the mass of the individual particle of developer material, and $V$ is the velocity magnitude of the tape 3. When the centrifugal force F exceeds the forces restraining individual particles 17 upon the tape 3, individual particles 17 become displaced from tape 3 or from other particles of developing material upon which they reside. Although other, inter-particulate forces are involved, the primary restraining force in magnetic imaging systems is the magnetic force exerted upon particle 17 by the latent magnetic image. Once particle 17 becomes displaced from tape 3 it is then removed by streams of air 18 and 19 as well as the positive pressure air flow through chamber 12 and opening 14, which all enter chamber 10. The particle-laden air in chamber 10 passes through the negative pressure side of fan 7 and into chamber 11 where it is directed through filter 8 when valve 15 is closed or through both filters 9 and 8 when valve 15 is open. Filter 8 serves to remove the developing material particles from the air so as to avoid their being deposited once again upon tape 3 as it passes beneath opening 14 of chamber 12. Filter 9 likewise traps and removes developing material particles from air which is directed through bleed off line 16 and into the atmosphere. Baffles 4 and 5 are located closely adjacent and substantially parallel to tape 3 along its path of travel in the region of vacuum assembly 6. Baffles 4 and 5 minimize the turbulence of air streams 18 and 19 and ensure that these air streams are flowing substantially parallel to the path of travel of tape 3 and at a velocity sufficient to remove detached individual particles 17 of developing material.

Figure 2:
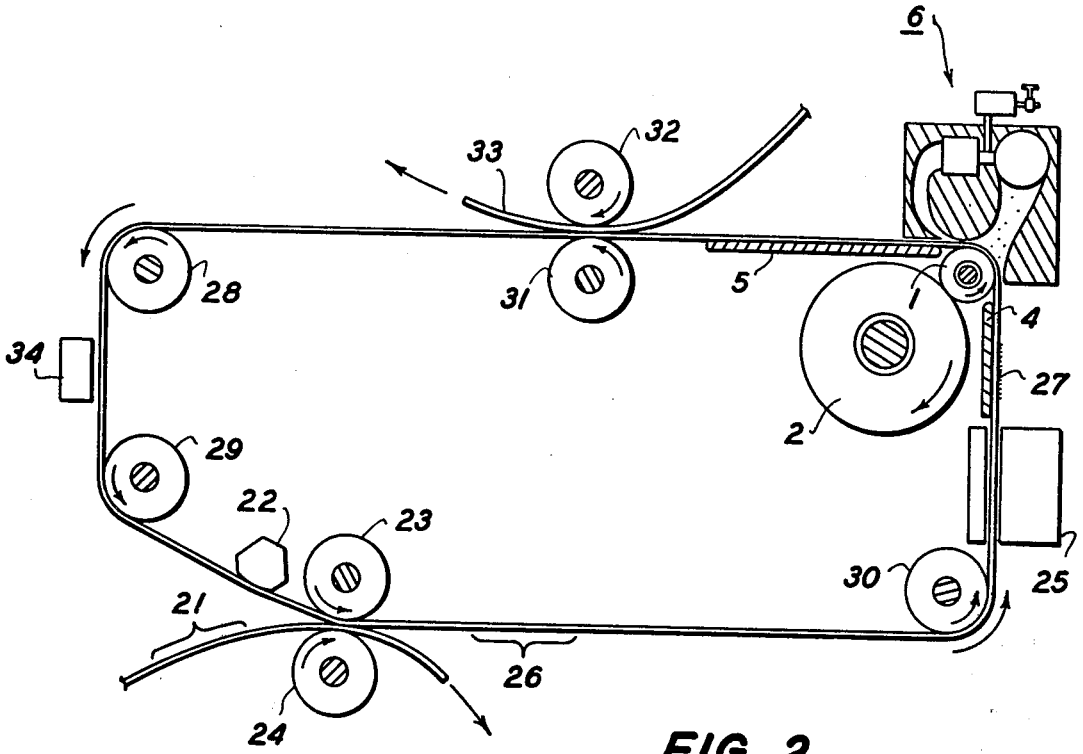
FIG. 2 is a schematic illustration of a general scheme of combining the preferred embodiment of the present invention with imaging systems wherein a magnetic latent image is created upon a member, developed, transferred to a copy medium and erased.

FIG. 2 schematically illustrates the placement of the present invention in a typical cyclical magnetic imaging system. While repetitive, cyclical imaging is a preferred system embodiment of most imaging systems due to the high output speed of the system in terms of numbers of copies as compared to a stationary flat bed imaging system, it will be understood and appreciated that the present invention can be practiced in any imaging system wherein a latent image is developed with developing material. In cyclical magnetic imaging systems such as, for example, that disclosed in U.S. Pat. No. 3,804,511, hereby expressly incorporated by reference, latent magnetic images 21 are created on magnetizable members 20 by any of several known means. In FIG. 2, latent magnetic image 21 is transferred to magnetic tape 3 by means of Curie-point transfer methods known in the art such as, for example, those disclosed in U.S. Pat. Nos. 3,803,633, 3,496,304; and 3,364,496, which three patents are hereby expressly incorporated by reference. The Curie-point transfer technique is also referred to as thermoremanent transfer.

Returning now to FIG. 2, hot shoe 22 heats magnetic tape 3 above its Curie-point and tape 20 is brought into contact with tape 3 by cool rollers 23 and 24 which lower the temperature of tape 3 below is Curie-point while tape 3 is in intimate contact with tape 20. As a result of this process, the latent image 21 is duplicated in tape 3 and indicated in FIG. 2 as latent magnetic image 26. Tape 3 passes through developer 25 containing particulate magnetic developing material and emerges bearing developer material 27. Any conventional developer system can be employed. Some of developing material 27 is in imagewise configuration while some of developing material 27 is randomly deposited on tape 3 in background areas. As tape 3 passes around roller 1, the excessive developing material is subjected to an acceleration normal to tape 3, thereby becoming displaced therefrom and ultimately removed by vacuum assembly 6. The remaining developed image on tape 3 then passes between drive roller 31 and roller 32 which bring tape 3 in intimate contact with copy medium 33 whereupon the remaining imagewise configured developing material is pressure transferred to copy medium 33. Subsequent to transfer, tape 3 is driven by roller 28 past erasing station 34 whereupon the latent magnetic image 26 on tape 3 is erased.

Figure 3:
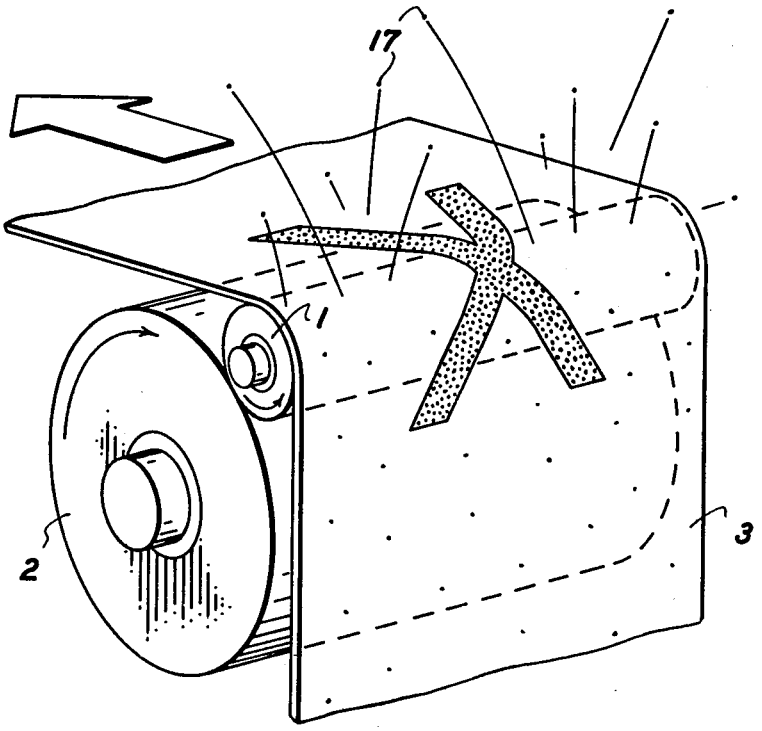
FIG. 3 is a schematic illustration of the displacement of excessive developing material from a developed latently imaged imaging member by application of centrifugal force.

FIG. 3 schematically illustrated in more detail the relationship between rollers 2 and 1, and magnetic tape 3. More particularly, it can be seen that individual particles 17 of excessive developing material are being displaced from tape 3 when it is driven over roller 1. In the direction of travel, it is seen that a first portion of the letter "X" is free of background and over-development whereas a latter portion of that letter is in the process of being cleaned when subjected to centrifugal acceleration.

Tables 1–4 illustrate the behavior of a particular developing material as a function of variable parameters of the preferred embodiment of the present invention and assist greatly in an understanding of the practice of the present invention. While the date presented in these tables are for one particular developing material, the behavior is characteristic of developing materials in general. In all of tables 1–4 the magnetic imaging member is CROLYN, a trademark of E.I. Dupont de Nemours, Inc. for chromium dioxide videotape and the developing material was electrically neutralized prior to being subjected to the acceleration in order to minimize electrostatic retention forces. However, the invention can be practiced successfully when the electrostatic background forces are small compared to the magnetic image forces. In all, the developing material is MAGNAFAX 611, commercially available under that trademark from Surface Processes, Inc. of Pennsylvania, subsequently treated for Table 1 with about 0.4% by weight CAB-O-SIL, a trademark for colloidal pyrogenic silica pigment, available from the Cabot Corporation and treated for Tables 2–4 with about 1% by weight SILANOX, a trademark for a fumed silicate also available from CABOT. The method of treatment is simply any dry blend treatment where intimate contact and substantially uniform distribution of the two components is achieved such as, for example, by roll-milling. The magnetization wavelength utilized in Tables 1–3 creating the magnetic latent images is about 50 microns.

TABLE I

| Centrifugal Acceleration in Gravities | Solid Area Transmission Optical Density | Background Transmission Optical Density |
|---|---|---|
| 1 | 2.4 | .0115 |
| 22 | 2.5 | .0067 |
| 50 | 2.5 | .0055 |
| 89 | 2.5 | .0032 |
| 200 | 2.45 | .0028 |
| 360 | 2.3 | .0018 |
| 800 | 2.1 | .0008 |
| 1420 | 1.35 | .0013 |
| 3200 | .3 | .0008 |
| 7200 | .2 | .0013 |

Table 1 illustrates the variation in solid area and background optical densities as a function of centrifugal acceleration imparted to the magnetic imaging member. The date in Table 1 demonstrates that for this magnetization wavelength and this particular treated toner, the solid area (image) optical density begins to decrease at about 360 gravities, the optical density of the background, however, continues to decline throughout the entire range of from about 20 to about 3000 gravities. Since changes in optical densities are related to changes in the amount of developing material per unit area of developed surface, it is clear that the application of increasing centrifugal acceleration results in the removal of developing material from both background and solid (image) areas. The solid area optical densities were measured in transmission and the background optical densities were obtained by counting particles in microscope photographs. For example, a solid area density of about 2 indicates that only about 1% of light is reflected or absorbed and 99% is transmitted, whereas a background optical density of about $10 \times 10^{-3}$ indicates that about 2.3% of the background area measured is covered with developing material.

With respect to multiple layers of developing material, one residing atop the other, it has been determined by optical density measurements that developing material to a height of about 1 ½ times the developing material average diameter is optimum, and at least a single monolayer is preferred, for economy of material and ease of transfer to copy medium without substantially adversely affecting the desirable optical density of the viewed image. Table 2, in this regard, illustrates the centrifugal acceleration required to separate first and second monolayers of the developing material and illustrates the variation in transmission optical density of developing material remaining on the latent magnetic image as a function of centrifugal acceleration.

TABLE 2

| Centrifugal Acceleration in Gravities | | Solid Area Transmission Optical Density |
|---|---|---|
| 22 | | 2.10 |
| 89 | | 2.05 |
| approx. 200 | (microscopically observed starting point for second monolayer breakup) | |
| 360 | | 1.40 |
| approx. 800 | (microscopically observed starting point for first monolayer breakup) | .80 |
| 1090 | .50 | |
| 1420 | .26 | |
| 2225 | | .12 |
| 3200 | | .07 |

Table 2 demonstrates that a centrifugal acceleration of about 200 gravities will displace for removal developing material in excess of the second monolayer whereas a centrifugal acceleration of approximately 800 gravities will remove developing material in excess of the first monolayer. Optimum optical density is in the range of about 1.4 to about 1.5 and, accordingly, it is demonstrated that a centrifugal acceleration of about 350 gravities is optimum for removing excessive amounts of this developing material from a developed magnetic latent image having a magnetization wavelength of about 50 microns.

For Table 3, prior to measurement of optical density the developed image which has been subjected to the practice of the present invention is transferred to paper and fixed thereto by the application of heat. The optical density in Table 3 is reflection optical density which tends to saturate at about 1.3 owing, it is believed, to front surface reflection.

TABLE 3

| Centrifugal Acceleration in Gravities | Solid Area Reflection Optical Density on Xerox ® 1024 ® Paper |
|---|---|
| 35 | 1.37 |
| 140 | 1.38 |
| 315 | 1.38 |
| 550 | 1.35 |
| 870 | 1.13 |
| 1240 | .92 |

Table 4 demonstrates that for a particular magnetic toner, and a particular centrifugal acceleration, optical density falls off for long wavelengths of magnetization at moderate centrifugal acceleration because the magnetic forces are weak. Optical density falls off for short wavelengths of magnetization because the magnetic force has insufficient range to hold sufficient toner particles having an average diameter of about 10 microns. In the mid-range of magnetization wavelengths (about 30 microns to about 60 microns) the optical density peak shifts from about 30 microns to about 60 microns as the centrifugal acceleration is decreased.

TABLE 4

| Centrifugal Acceleration in Gravities | Magnetization Wavelength in microns | Solid Area Reflection Optical Density on Xerox ® 1024 ® Paper |
|---|---|---|
| 140 | 20 | 1.17 |
| 140 | 25 | 1.35 |
| 140 | 30 | 1.35 |
| 140 | 40 | 1.36 |
| 140 | 50 | 1.38 |
| 140 | 60 | 1.42 |

TABLE 4-continued

| Centrifugal Acceleration in Gravities | Magnetization Wavelength in microns | Solid Area Reflection Optical Density on Xerox ® 1024 ® Paper |
|---|---|---|
| 140 | 80 | 1.40 |
| 140 | 100 | 1.39 |
| 550 | 20 | 1.22 |
| 550 | 25 | 1.30 |
| 550 | 30 | 1.31 |
| 550 | 40 | 1.32 |
| 550 | 50 | 1.29 |
| 550 | 60 | 1.40 |
| 550 | 80 | 1.15 |
| 550 | 100 | .78 |
| 1240 | 20 | .85 |
| 1240 | 25 | 1.1 |
| 1240 | 30 | 1.22 |
| 1240 | 40 | 1.05 |
| 1240 | 50 | .95 |
| 1240 | 60 | .76 |
| 1240 | 80 | .52 |
| 1240 | 100 | .32 |

In summary, Tables 1 through 4 demonstrate that sufficient differences exist in the forces restraining excessive developing material in background and image areas such that an acceleration can be applied to an imaging member to remove excessive background developing material and to remove excessive developing material from overdeveloped image areas without adversely affecting the optical density of the residual developed image.

It will be appreciated that other variations and modifications will occur to those skilled in the art upon a reading of the present disclosure. These are intended to be within the scope of this invention.

For example, referring again to FIG. 1, it will be appreciated that roller 1 utilized to subject tape 3 to the desired centrifugal force need not be a roller but rather it can be either an arcuate or angular portion of a member such as a metal guide over which the tape 3 passes in its path of travel. For appropriate arcuate diameters, rollers, blades or edges can be employed. Further, it will be appreciated that vacuum assembly 6 need not be limited to the arrangement and structure shown in FIG. 1 but that any suitable means for creating streams of air in the vicinity of roller 1 at a velocity sufficient to remove displaced particles 17 from the vicinity of tape 3 can be utilized.

Embodiments of the present invention can comprise any means of subjecting the member carrying developing material to the desired acceleration. These means can be generally conveniently divided into two classes: means which change the direction of the member such as, for example, guide means which subject a moving member to a change in direction and thereby an acceleration, and means which increase the velocity of the member without change in direction such as stepping motors, slipping gears, or ratchet drives which are increased in frequency of operation to accelerate the member.

Embodiments incorporating the first class of means are generally preferred due to the displacement of developer material away from the member and the resulting absence of problems such as member-developer drag, smear, etc. In the preferred embodiments at speeds of about 50 to 250 cm/sec and with presently known developer and tape materials, centrifugal accelerations of about 10 to about 3,000 gravities will adequately remove developer material from background areas of the tape and in image areas will remove all but the single monolayer of developer residing on the tape over the latent magnetic image. The radius of curvature for arcuate guide means between 0.1 to about 10 mm will provide the above gravities at velocity magnitudes of between 50 to about 250 cm/sec.

While the above parameters of acceleration are a function of materials, and fixed for any specified combination of tape-developer material and magnetization wavelength, it will be appreciated that the radius of curvature required is a function of the desired member velocity. Accordingly, the above parameter ranges are given for illustration only and do not limit the scope of the present invention. For example, for either extremely high or low speeds, or for materials that may be discovered in the future, a centrifugal acceleration less than 10 gravities will suffice for developer displacement from the tape; or, acceleration in excess of 3000 gravities may be required. Further, member velocities in excess of 250 cm/sec may be desired for very high speed duplication. Any of these considerations will affect the radius of curvature required in the preferred embodiments of the present invention.

What is claimed is:

1. Apparatus for displacing magnetic toner from a member bearing a latent magnetic image and having deposited thereon magnetic toner in both imagewise configuration and background areas, comprising:

a. means for moving the member; and b. acceleration means at a toner removal station in the movement path for applying an acceleration to said mwmber only at said station of a magnitude sufficient to displace magnetic toner from background areas but insufficient to displace all of the magnetic toner in imagewise configuration.

2. The apparatus according to claim 1 wherein the acceleration means comprises guide means for changing the direction of movement of said member.

3. The apparatus according to claim 2 wherein said guide means has an arcuate portion over which said member moves.

4. A magnetic imaging system comprising:

a. means for latently magnetically imaging a web member;

b. means for moving the member through a path of travel at a predetermined velocity magnitude; and c. guide means at a toner removal station having an arcuate portion in the path of travel of a radius sufficient to subject said member only at said station at the velocity magnitude to a centrifugal acceleration normal to said member and of magnitude sufficient to displace magnetic toner from background portions of the latently imaged member but insufficient to detach all of the magnetic toner from image portions of the latently imaged member.

5. The system according to claim 4 further including means along the path of travel for transferring magnetic toner from said member to a copy medium.

6. The system according to claim 5 further including means along the path of travel for depositing magnetic toner on said member.

7. The system according to claim 6 wherein said guide means is located intermediate the means for depositing magnetic toner and the means for transferring magnetic toner.

8. The system according to claim 4 wherein said means for latently magnetically imaging the member includes means for heating the member.

9. The system according to claim 8 wherein said means for latently magnetically imaging the member includes means for intimately contacting the member with another member bearing a latent magnetic image.

10. The system according to claim 4 wherein said arcuate portion radius is from about 0.1 to about 10 millimeters.

11. The system according to claim 4 wherein the predetermined velocity is from about 50 to about 250 centimeters per second.

12. The system according to claim 4 wherein the centrifugal acceleration is from about 10 to about about 3000 gravities.

13. A magnetic imaging process, comprising:

a. providing a latently magnetically imaged web member bearing magnetic toner in imagewise configuration corresponding to image portions of the latent image and magnetic toner in background portions of the latent image, and b. subjecting the member to acceleration of predetermined magnitude only along a portion of its path of travel sufficient to displace the magnetic toner from background portions of the latent image but insufficient to displace all of the magnetic toner in imagewise configuration.

14. The process of claim 13 wherein the travel path portion has a radius of from about 0.1 to about 10 millimeters.

15. The process of claim 13 wherein the centrifugal acceleration is from about 10 to about 3000 gravities.

16. The process of claim 13 wherein the predetermined velocity is up to about 250 centimeters per second.

17. In a magnetic imaging process wherein a latently magnetically imaged web member is developed so that said member bears magnetic developer material in both imagewise configuration and in background areas, the improvement comprising subjecting the member to an acceleration only along a portion of its path of travel of a magnitude sufficient to displace magnetic developer material in background areas but insufficient to displace all of the developer material in imagewise configuration.

18. In a magnetic imaging system wherein a latently magnetically imaged web member is developed so that said member bears magnetic developer material in both imagewise configuration and in background areas, the improvement comprising acceleration means at a toner removal station for applying an acceleration only at said station to the member of a magnitude sufficient to displace magnetic developer from background areas but insufficient to displace all of the magnetic toner in imagewise configuration.

* * * * *